US008066590B2

(12) United States Patent
Doherty

(10) Patent No.: US 8,066,590 B2
(45) Date of Patent: Nov. 29, 2011

(54) BUNT TRAINING AID

(76) Inventor: Dennis M. Doherty, Ferguson, MO (US)

( * ) Notice: Subject to any disclaimer, the term of this patent is extended or adjusted under 35 U.S.C. 154(b) by 0 days.

(21) Appl. No.: 12/565,315

(22) Filed: Sep. 23, 2009

(65) Prior Publication Data

US 2011/0070980 A1 Mar. 24, 2011

(51) Int. Cl.
*A63B 69/00* (2006.01)

(52) U.S. Cl. ..... 473/457; 473/422

(58) Field of Classification Search ..... 473/457, 473/422, 451, 564, 566, 453, 515, 507, 510; D21/724, 725, 466; 124/5
See application file for complete search history.

(56) References Cited

U.S. PATENT DOCUMENTS

| | | | | | |
|---|---|---|---|---|---|
| 1,017,376 | A | * | 2/1912 | Brandt | 473/507 |
| 1,189,921 | A | * | 7/1916 | Cory | 473/515 |
| 1,944,628 | A | * | 1/1934 | Barker | 473/507 |
| 2,042,984 | A | * | 6/1936 | Fritz | 473/505 |
| 2,194,761 | A | * | 3/1940 | Maihack | 473/509 |
| 3,115,342 | A | * | 12/1963 | Webster | 473/457 |
| 3,122,365 | A | * | 2/1964 | August | 473/453 |
| 3,169,019 | A | | 2/1965 | Genjack | |
| 3,206,195 | A | | 9/1965 | Myers | |
| 3,268,226 | A | | 8/1966 | Martino | |
| D325,612 | S | * | 4/1992 | Longo | D21/725 |
| 5,269,511 | A | | 12/1993 | Chavez | |
| D358,859 | S | | 5/1995 | Bernardo | |
| 6,186,909 | B1 | | 2/2001 | Swanson, Jr. | |
| 6,565,462 | B1 | | 5/2003 | Gregg | |
| 6,923,738 | B1 | * | 8/2005 | Fulp | 473/457 |
| D537,893 | S | * | 3/2007 | Freeland | D21/722 |
| D555,035 | S | * | 11/2007 | O'Neal | D21/725 |
| 2003/0134698 | A1 | | 7/2003 | Clark et al. | |
| 2004/0162167 | A1 | * | 8/2004 | Stevens et al. | 473/457 |
| 2006/0199678 | A1 | * | 9/2006 | Benassi | 473/457 |
| 2008/0039241 | A1 | | 2/2008 | Pope | |
| 2009/0191986 | A1 | * | 7/2009 | Bohm | 473/457 |

* cited by examiner

*Primary Examiner* — Mitra Aryanpour
(74) *Attorney, Agent, or Firm* — Brian B. Diekhoff; Polsinelli Shughart PC

(57) ABSTRACT

A bunt training aid is described. The bunt training aid is used by baseball, softball and other game players to improve their bunting ability. The bunt training aid teaches the player how to catch a ball with a bat.

The bunt training aid includes a handle portion, a barrel portion, and a receiving member. The receiving member defines an opening sized to permit a ball to pass through the opening. The receiving member includes a first attachment member to attach the receiving member to the handle portion. The receiving member includes a second attachment member to attach the receiving member to the barrel portion. The receiving member is positioned between the handle portion and the barrel portion. A net is attached to the receiving member in order to hold the ball that has passed through the opening.

26 Claims, 7 Drawing Sheets

BUNT TRAINING AID

FIELD OF INVENTION

The present invention relates to a bunt training aid.

BACKGROUND OF INVENTION

Bunting is a fundamental skill needed in baseball and softball. Bunting is especially important in softball. Bunting may be used by a batter to advance a runner that is already on base. Bunting allows the player to softly hit the ball in a desired direction, preferably away from a fielder, while still hitting the ball in the playing field. As opposed to normal hitting, the bunter is not attempting to make contact with the ball in order to direct the ball with high velocity to the infield or out of the infield and into the outfield. Instead, bunting involves contacting the bat with the ball in relatively slow, directionally orientated movement in order to place the ball in the infield area away from a fielder.

When bunting, the player attempts to deaden the ball directed towards the player by gently receiving the ball against a contact surface of the bat. When learning to bunt, the player is often taught or trained to attempt to attempt "catch" the ball with the bat. A conventional baseball or softball bat is not able to catch a ball.

SUMMARY OF INVENTION

A bunt training aid is herein described. The bunt training aid is used by baseball, softball and other game players to improve their bunting ability. The bunt training aid allows the players to improve and hone their bunting ability. The bunt training aid teaches the players to catch the ball with their bats.

The bunt training aid includes a handle portion, a barrel portion, and a receiving member. The receiving member defines an opening sized to permit a ball to pass through the opening. The receiving member includes a first attachment member to attach the receiving member to the handle portion. The receiving member includes a second attachment member to attach the receiving member to the barrel portion. The receiving member is positioned between the handle portion and the barrel portion. The receiver member is positioned at an approximate "sweet spot" of the bunt training aid. The ball is caught in the receiving member.

In a first embodiment, the bunt training aid includes a receiving member that forms loops that are positioned inside of the handle portion and inside of the barrel portion. The loops extend from a ring that forms an opening for the ball to pass through.

In a second embodiment, the bunt training aid includes a receiving member that forms circular connectors that join to a rim of the handle portion and to a rim of the barrel portion. The circular connectors attach or connect with a ring of the receiving member.

In a third embodiment, the bunt training aid includes a receiving member that forms cylindrical connectors that extend into the handle portion and into the barrel portion. The cylindrical connectors attach or connect to a ring of the receiving member.

In a fourth embodiment, the bunt training aid includes a receiving member that forms flanges that extend into the handle portion and into the barrel portion. The flanges connect or attach to a ring of the receiving member.

In a fifth embodiment, the bunt training aid includes a receiving member that permits a player to removably position and exchange the receiving member into and out of the bunt training aid. The receiving member forms an expanding engagement member that tightens against interior surfaces of the handle portion and the barrel portion.

In a sixth embodiment, the bunt training aid includes a receiving member that attaches to interior surfaces of the handle portion and the barrel portion via clips.

DETAILED DESCRIPTION OF PREFERRED EMBODIMENTS

Figure 1:
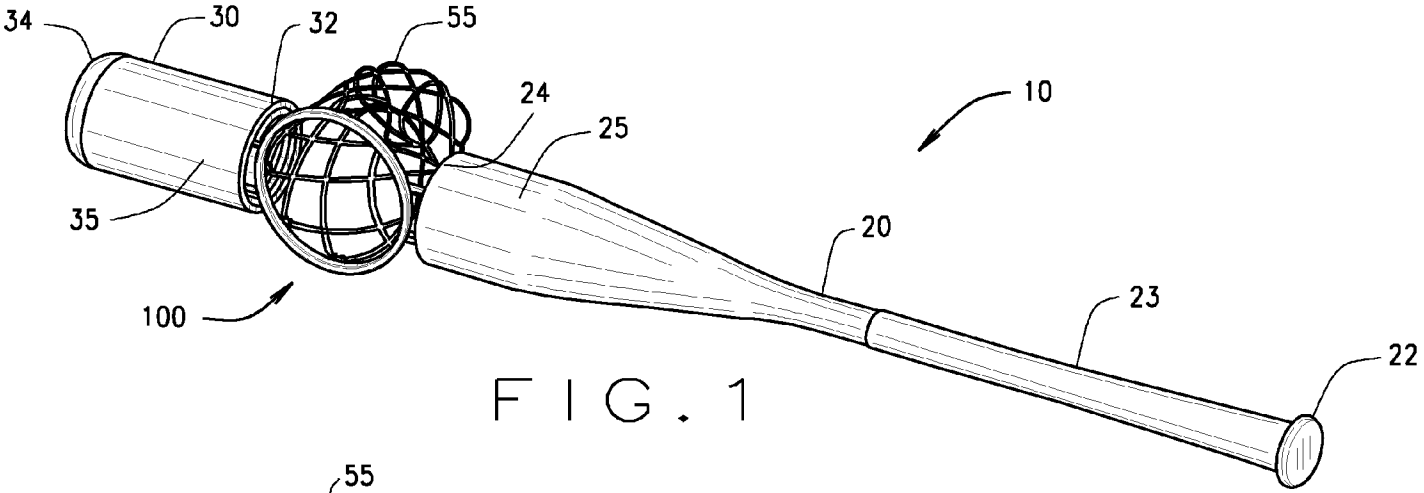
FIG. 1 is a perspective view of the first embodiment of the bunt training aid.
Figure 2:
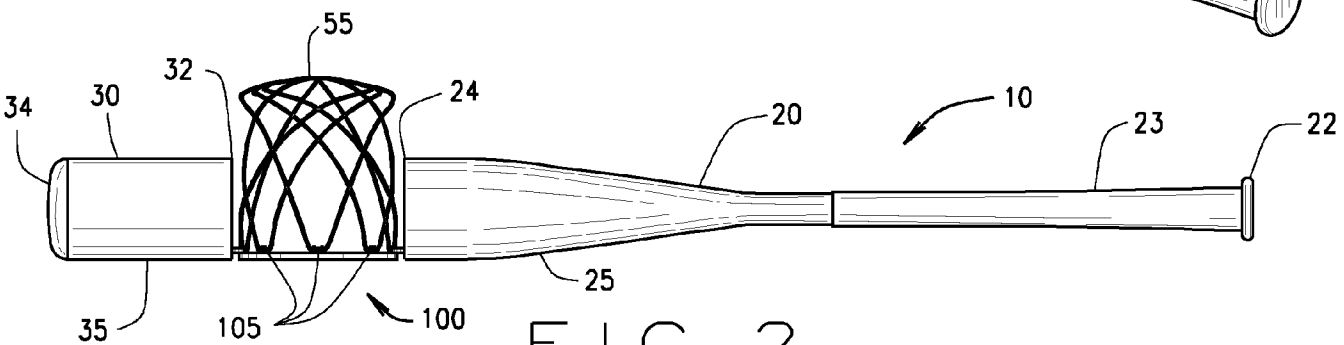
FIG. 2 is a side view of the first embodiment of the bunt training aid.
Figure 3:
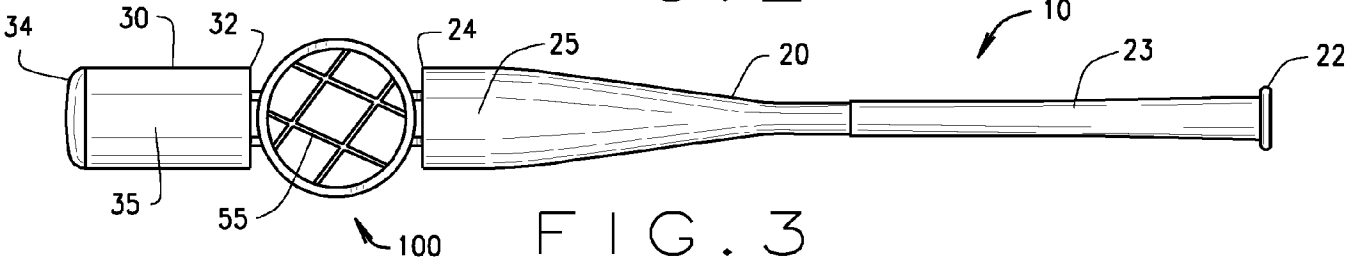
FIG. 3 is a top view of the first embodiment of the bunt training aid.
Figure 4:
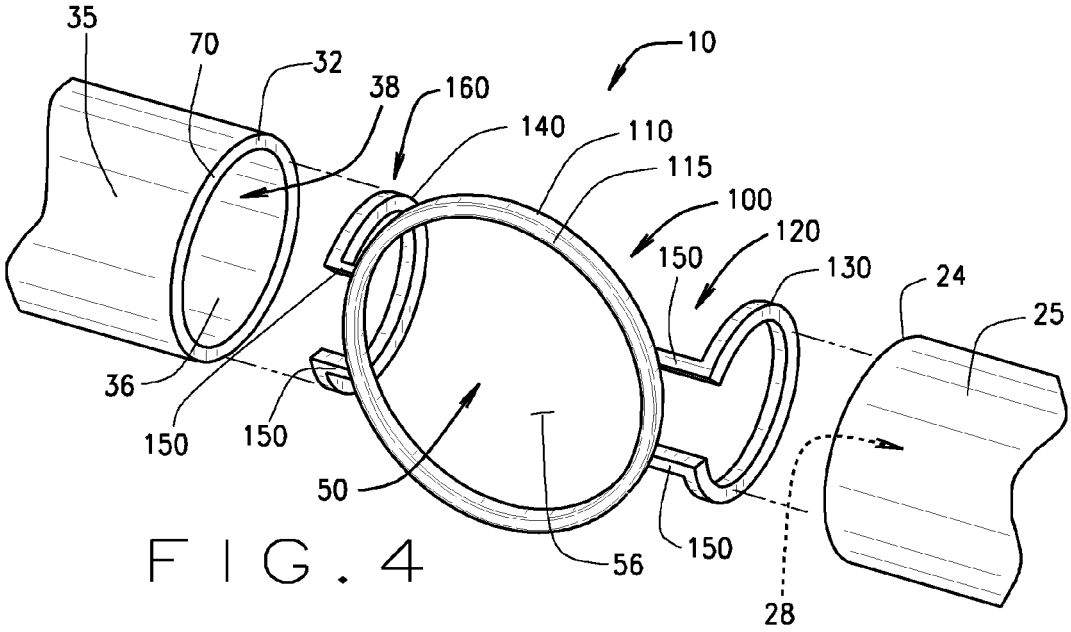
FIG. 4 is an exploded view of the first embodiment of the bunt training aid.
Figure 5:
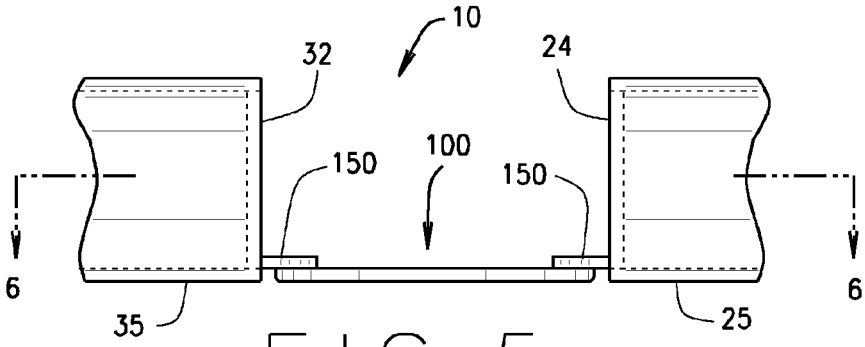
FIG. 5 is top view of the receiving member of the first embodiment of the bunt training aid.
Figure 6:
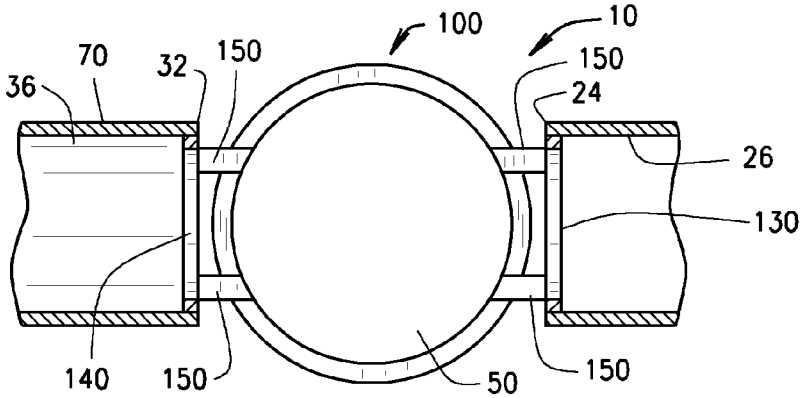
FIG. 6 is a cross-sectional view of the receiving member of the first embodiment of the bunt training aid.

A bunt training aid will now be described with reference to the FIGURES. A first embodiment of the bunt training aid 10 is shown in FIGS. 1-6. The bunt training aid 10 comprises a handle portion 20 and a barrel portion 30.

The handle portion 20 comprises a first end 22 and a second end 24. The barrel portion 30 comprises a first end 32 and a second end 34. The handle portion 20 forms a handle 23 for the bunt training aid 10 for the player to grip in order to use the bunt training aid 10 to practice bunting.

An inside 28 of the handle portion 20 is generally hollow, while an inside 38 of the barrel portion 30 is also generally hollow. A handle wall 60 forms the handle portion 20, and a barrel wall 70 forms the barrel portion 30.

Generally, the handle portion 20 is narrower in dimension than the barrel portion 30. The handle 23 transitions into a rounded ball contacting surface 25 of the handle portion 20. The rounded ball contacting surface 25 is an exterior side of the handle wall 60.

The handle portion 20 has a generally round outer diameter forming the rounded ball contacting surface 25. Likewise, the barrel portion 30 forms a generally round outer diameter having a rounded ball contacting surface 35. The rounded ball contacting surface 35 is the exterior side of the barrel wall 70.

The bunt training aid 10 comprises a receiving member 100, which defines an opening 50 sized to permit a ball to pass through the opening 50. The receiving member 100 is positioned between the handle portion 20 and the barrel portion 30. The barrel portion 20 and the handle portion 20 generally deflect a ball away from the bunt training aid 10 that strikes either the barrel portion 30 or the handle portion 20. As such, the player may catch the ball in the receiving member 100 when the bunt training aid 10 is properly aligned with a trajectory of the ball that is directed toward the player. If the bunt training aid 10 is not properly aligned with the trajectory of the ball directed toward the player, then the ball will not enter the receiving member 100 and the ball may strike the barrel portion 20 or the handle portion 30 and deflect away from the bunt training aid 10, or the ball may miss the bunt training aid 10 completely.

The receiving member 100 further comprises a first attachment member 120 to attach the receiving member 100 to the handle portion 20. The receiving member 100 further comprises a second attachment member 160 to attach the receiving member 100 to the barrel portion 30. The receiving member 100 is attached to the second end 24 of the handle portion 20 and to the first end 32 of the barrel portion 30 via welding, adhesives, epoxy, rivets or metal fasteners.

The opening 50 of the receiving member 100 is dimensioned to permit a softball, baseball, or other ball to pass through the opening 50. The opening 50 of the receiving member 100 is generally circular. In the embodiment shown in FIGS. 1-6, the receiving member 100 is a ring 110. The ring 110 has a generally round cross-section or a hemispherical cross-section that forms a rounded contact surface 115 on an exterior of the ring 110.

A net 55 is attached to net engaging members 105 on the receiving member 100. The net 55 may be permanently attached to the net engaging members 105, or, preferably, the net 55 is removably attachable to the net engaging members 105. The net 55 receives and holds the ball that has passed through the opening 50 of the receiving member 100.

The receiving member 100 includes the first attachment member 120 and the second attachment member 160. The first attachment member 120 extends into the inside 28 of the handle portion 20, and the second attachment member 160 extends into the inside 38 of the barrel portion 30. The first attachment member 120 attaches to an internal surface 26 of the second end 24 of the handle portion 20. The second attachment member 160 attaches to an internal surface 36 of the first end 32 of the barrel portion 30.

The receiving member 100 may be made from any suitable metal, such as, for example, steel, iron, metal, or metal alloys. The receiving member 100 should be rigid enough to withstand repeated use while maintaining its shape.

The barrel portion 20 and the handle portion 30 may be made from suitable aluminum or aluminum alloys conventionally used in the construction of baseball and softball bats. Suitable aluminum alloys include a CU31 alloy, a 7046 alloy, a C405 alloy and other aluminum alloys conventionally used by those in the art of aluminum bat production.

The receiving member 100 is positioned approximately at a "sweet" spot of the bunt training aid 10. The sweet spot is the place on a bat barrel of a conventional bat where the contact between bat and ball results in the best hit, often with minimal vibration felt in the players hands that are gripping the bat. Players are trained to use the sweet spot of a conventional bat for hitting and bunting a ball. The sweet spot is generally centered approximately four to approximately eight inches from the second end 34 of the barrel portion 30. As such, the receiving member 100 is generally positioned or centered at what would be the sweet spot of the bunt training aid 10, i.e., the receiving member 100 is positioned to place a center of the opening 50 at the sweet spot.

The bunt aid 10 generally defines a longitudinal axis, and a plane 56 of the opening 50 of the receiving member 100 is generally parallel to the longitudinal axis. The barrel portion 20 and the handle portion 30 have circular cross-sections, and the plane 56 of the opening 50 of the receiving member 100 is generally perpendicular to the circular cross-sections.

The handle portion 20, the barrel portion 30, and the receiving member 100 are generally separate components that are assembled into the bunt training aid 10. In certain embodiments, as later described herein, the receiving member 100 may be replaced with alternative receiving members.

In the embodiment shown in FIGS. 1-6, the first attachment member 120 and the second attachment member 160 form loops 130 and 140, respectively. The loops 130 and 140 extend from the ring 110. Extension members 150 connect the loops 130 and 140 with the ring 110. The loops 130 and 140 are formed as the first and second attachment members 120 and 160 bend generally perpendicular to the ring 110. A single piece of material may be bent and formed into one of the loops 130 or 140 with the extension members 150. The single piece of material may be welded or otherwise attached to the ring 110 at the extension members 150.

The loops 130 and 140 contact the most of or nearly the entire internal diameter of the handle portion 20 and the barrel portion 30. Specifically, the loop 130 is positioned against the internal surface 26 of the handle wall 60 of the handle portion 20, and the loop 140 is positioned against the internal surface 36 of the barrel wall 70 of the barrel portion 30.

A second embodiment will now be described with reference to FIGS. 7-9. The second embodiment is similar to the bunt training aid 10, except that a receiving member 200 is utilized. The receiving member 200 includes a first attachment member 220 that forms a circular connector 230 and a second attachment member 260 that also forms a circular connector 270. The first attachment member 220 and the second attachment member 260 are joined to a ring 210, which defines an opening 51.

Figure 7:
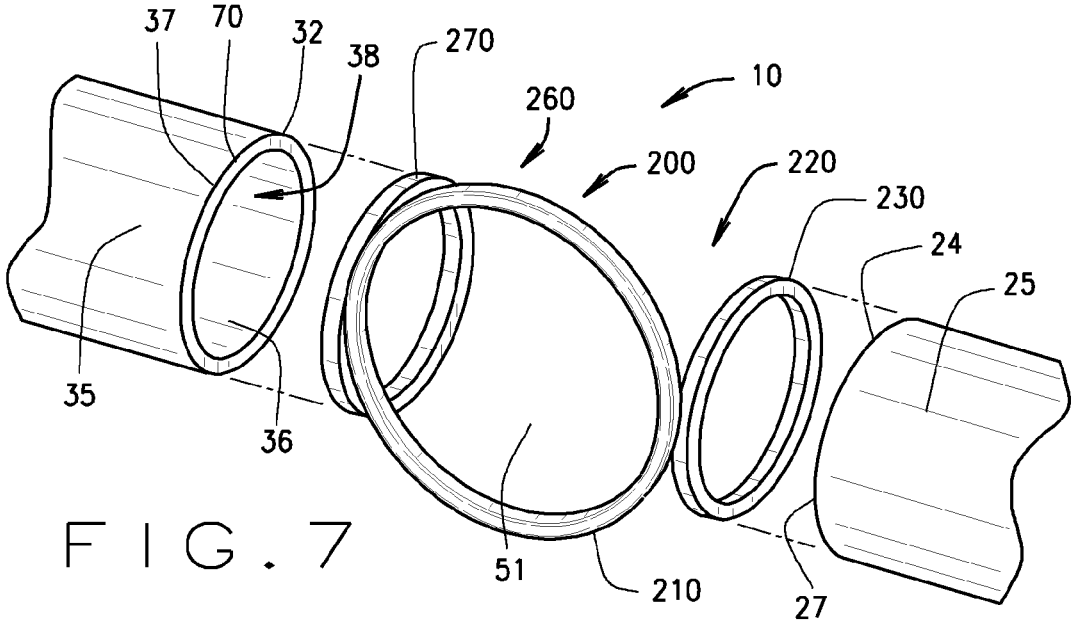
FIG. 7 is an exploded view of the second embodiment of the bunt training aid.
Figure 8:
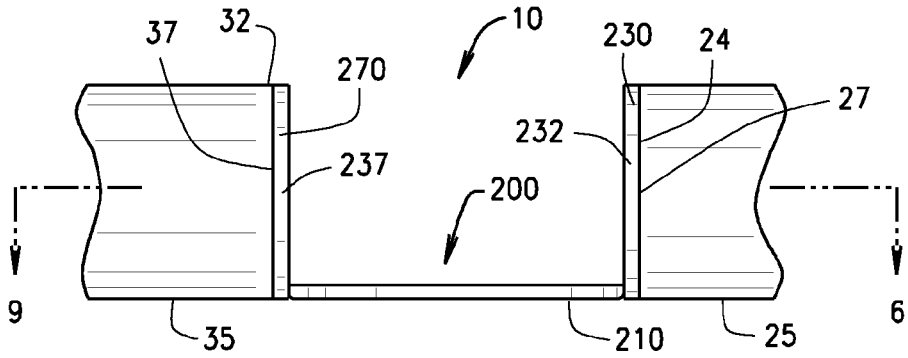
FIG. 8 is a top view of the receiving member of the second embodiment of the bunt training aid.
Figure 9:
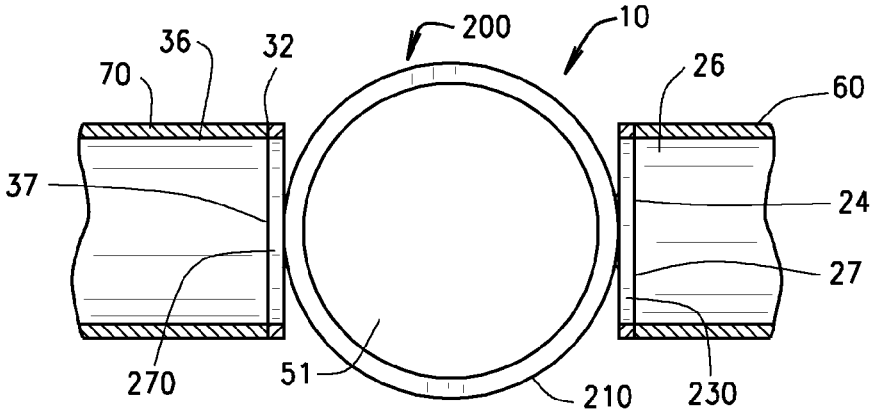
FIG. 9 is a cross-sectional view of the receiving member of the second embodiment of the bunt training aid.

With continued reference to FIGS. 7-9, the circular connector 230 is joined to a rim 27 of the handle portion 20. The circular connector 270 is joined to a rim 37 of the barrel portion 30. An outer surface 232 of the circular connector 230 is generally flush with the rounded ball contacting surface 25 of the barrel portion 20. An outer surface 237 of the circular connector 270 is generally flush with the rounded ball contacting surface 35 of the handle portion 30.

Figure 10:
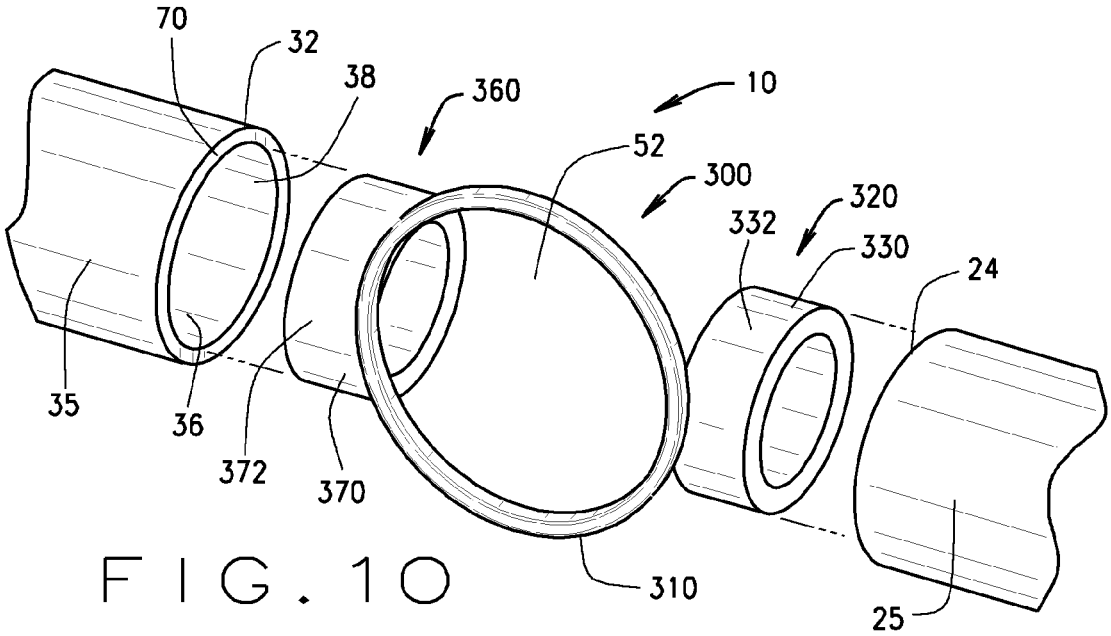
FIG. 10 is an exploded view of the third embodiment of the bunt training aid.
Figure 11:
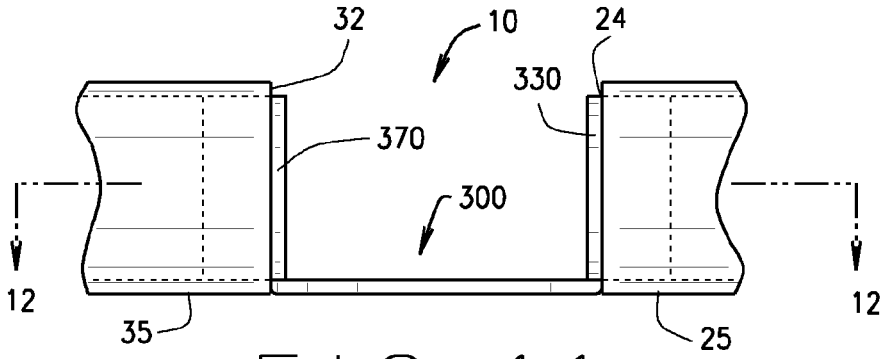
FIG. 11 is a top view of the receiving member of the third embodiment of the bunt training aid.
Figure 12:
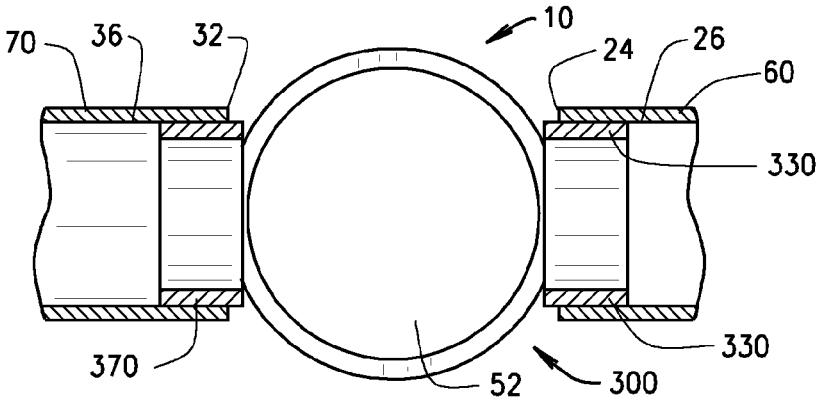
FIG. 12 is cross-sectional view of the receiving member of the third embodiment of the bunt training aid.

A third embodiment will now be described with reference to FIGS. 10-12. The third embodiment is similar to the bunt training aid 10, except that a receiving member 300 is utilized. The receiving member 300 includes a first attachment member 320 that forms a cylindrical connector 330 and a second attachment member 360 that also forms a cylindrical connector 370. The first attachment member 320 and the second attachment member 360 are joined to a ring 310, which defines an opening 52. The cylindrical connectors 330 and 370 are generally hollow or open in order to reduce their weight. The cylindrical connectors 330 and 370 form round surfaces 332 and 372 on their exterior. The cylindrical connectors 330 and 370 extend into the inside 28 of the handle portion 20 and into the inside 38 of the barrel portion 30. The round surfaces 332 and 372 nest against the internal surface 26 of the handle portion 20 and to the internal surface 36 of the barrel portion 30. The round surfaces 332 and 372 are connected or joined with the internal surfaces 26 and 36 via welding, adhesives, epoxy, rivets, or metal fasteners.

A fourth embodiment will now be described with reference to FIGS. 13-15. The third embodiment is similar to the bunt training aid 10, except that a receiving member 400 is utilized. The receiving member 400 includes a first attachment member 420 that forms a flange 430 and a second attachment member 460 that also forms a flange 470. The first attachment member 420 and the second attachment member 460 are joined to a ring 420, which defines an opening 53.

Figure 13:
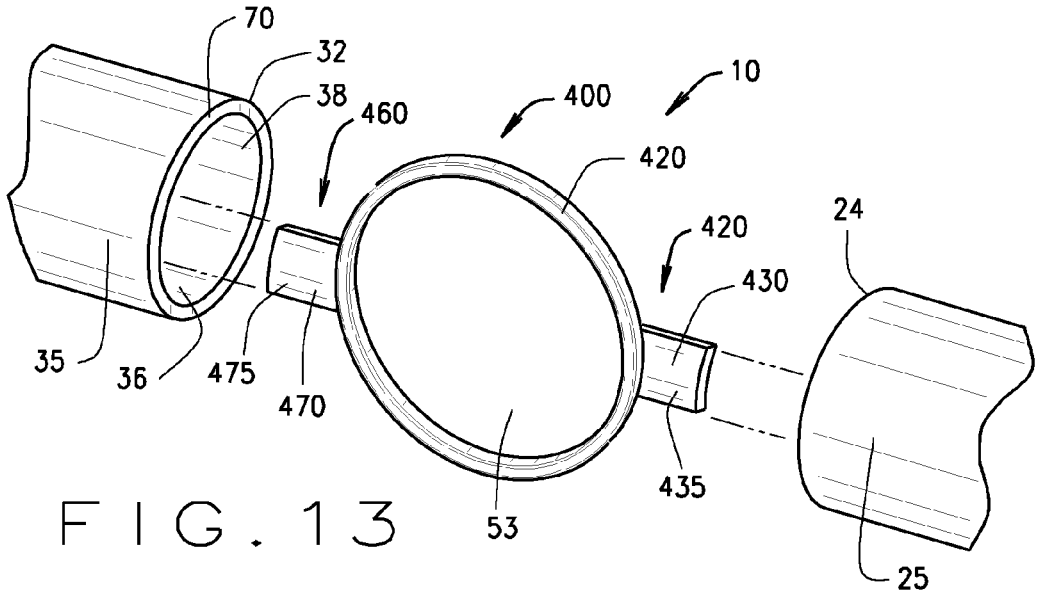
FIG. 13 is an exploded view of the fourth embodiment of the bunt training aid.
Figure 14:
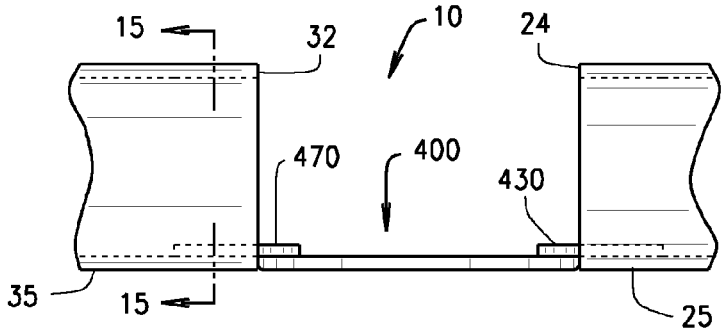
FIG. 14 is a top view of the receiving member of the fourth embodiment of the bunt training aid.
Figure 15:
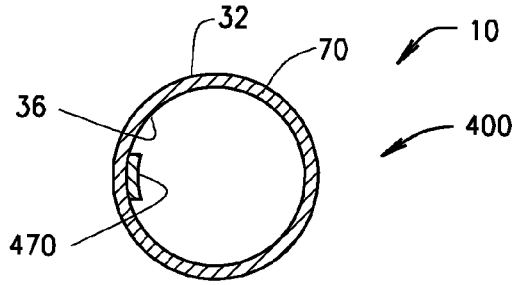
FIG. 15 is a cross-sectional view of the receiving member of the fourth embodiment of the bunt training aid.

With continued reference to FIGS. 13-15, the flanges 430 and 470 form curved attachment surfaces 435 and 475. The curved attachment surfaces 435 and 475 extend into the inside 28 of the handle portion 20 and into the inside 38 of the barrel portion 30. The curved attachment surface 435 and 475 conform to the internal surface 26 of the handle portion 20 and to the internal surface 36 of the barrel portion 30. The curved attachment surfaces 435 and 475 are fastened to the internal surface 26 of the handle portion 20 and to the internal surface 36 of the barrel portion 30 via welding, adhesives, epoxy, rivets or metal fasteners. The curved nature of the curved attachment surfaces 435 and 475 provide increased contact between the curved attachment surfaces 435 and 475 and the internal surface 26 of the handle portion 20 and the internal surface 36 of the barrel portion 30. The increased contact area provides a larger area for adhesives and welding to be applied, as well as provide a stronger and more supportive joint with the curved attachment surfaces 435 and 437 overlapping the internal surfaces 26 and 36.

A fifth embodiment will now be described with reference to FIGS. 16-18. The fifth embodiment is generally similar to the other embodiments of the bunt training aid 10, except that a receiving member 500 is utilized. This embodiment permits a player to removably position and exchange the receiving member 500 into and out of the bunt training aid 10. Different receiving members 500 may be removable exchanged that have different sized openings 54. The receiving member 500 is removably positioned between the second end 24 of the handle portion 20 and the first end 32 of the barrel portion 30. The receiving member 500 defines an opening 54. The receiving member 500 includes a first attachment member 520 that forms an expanding engagement member 530 and a second attachment member 560 that also forms an expanding engagement member 570.

Figure 16:
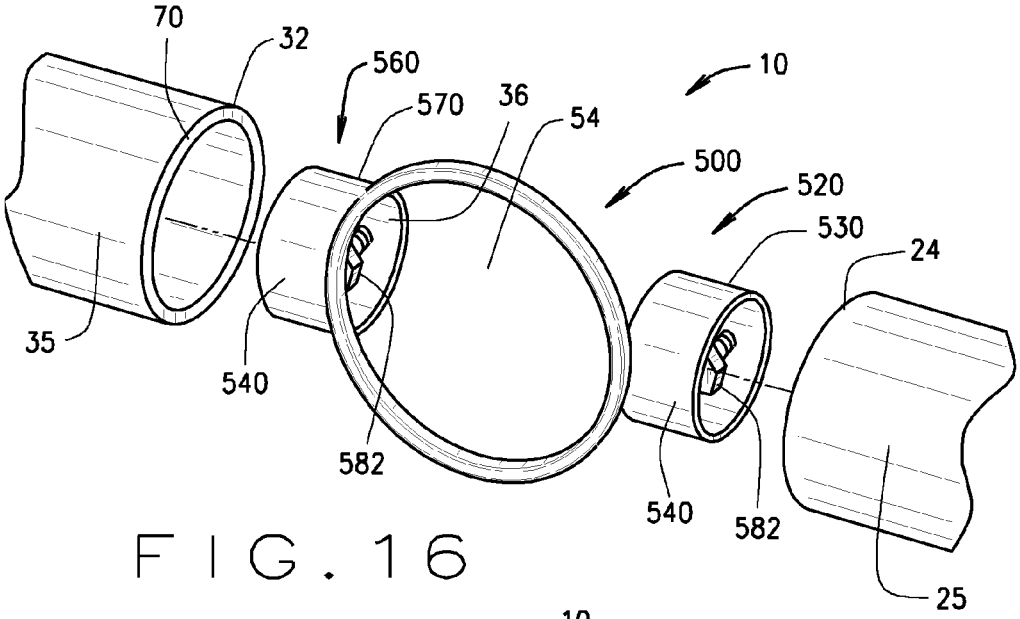
FIG. 16 is an exploded view of the fifth embodiment of the bunt training aid.
Figure 17:
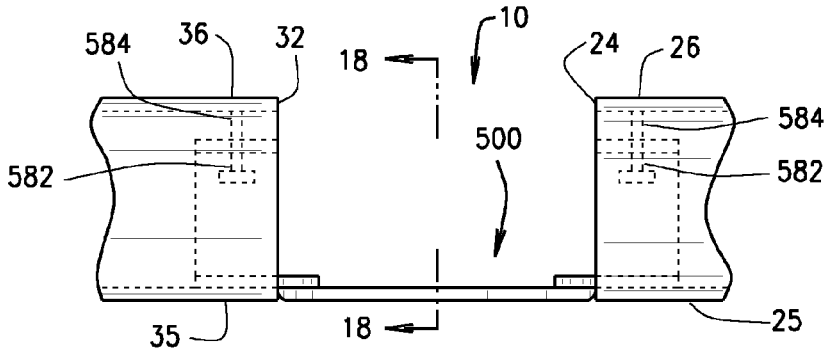
FIG. 17 is a top view of the receiving member of the fifth embodiment of the bunt training aid.
Figure 18:
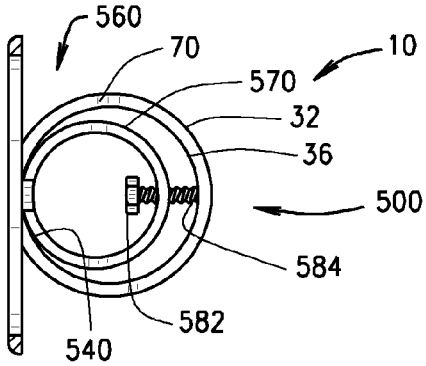
FIG. 18 is a cross-sectional view of the fifth embodiment of the bunt training aid.

With continued reference to FIGS. 16-18, the expanding engagement members 530 and 570 each have a cylindrical or circular structure that forms a contacting surface 540 that extends into the inside 28 of the handle portion 20 and into the inside 38 of the barrel portion 30. The expanding engagement members 530 and 570 each include a threaded member 582 that is threadably engaged to the cylindrical or circular structure. The threaded member 582 passes through the expanding engagement members 530 and 570. A first end 584 of the threaded members 582 contacts the internal surface 26 of the handle portion 20 and the internal surface 36 of the barrel portion 30. When the threaded members 582 are rotated, the contacting surfaces 540 are urged against the internal surface 26 of the handle portion 20 and against the internal surface 36 of the barrel portion 30, as the first end 584 of the threaded member 580 also urges against the internal surface 26 and the internal surface 36 on opposites sides of the internal surface 26 and the internal surface 36. As such, the expanding engagement members 530 and 570 may be tightened into position in the second end 24 of the handle portion 20 and in the first end 32 of the barrel portion 30.

A sixth embodiment will now be described with reference to FIGS. 19-21. The sixth embodiment is similar to the bunt training aid 10, except that a receiving member 600 is utilized. The receiving member 600 includes a first attachment member 620 that forms a loop 630 and a second attachment member 660 that also forms a loop 670. The loops 630 and 670 extend into the handle portion 20 and into the barrel portion 30. The loop 630 includes extension members 635. The loop 670 includes extension members 675. The extension members 635 and 675 are joined to a ring 605, which defines an opening 58 for the ball to pass through.

Figure 19:
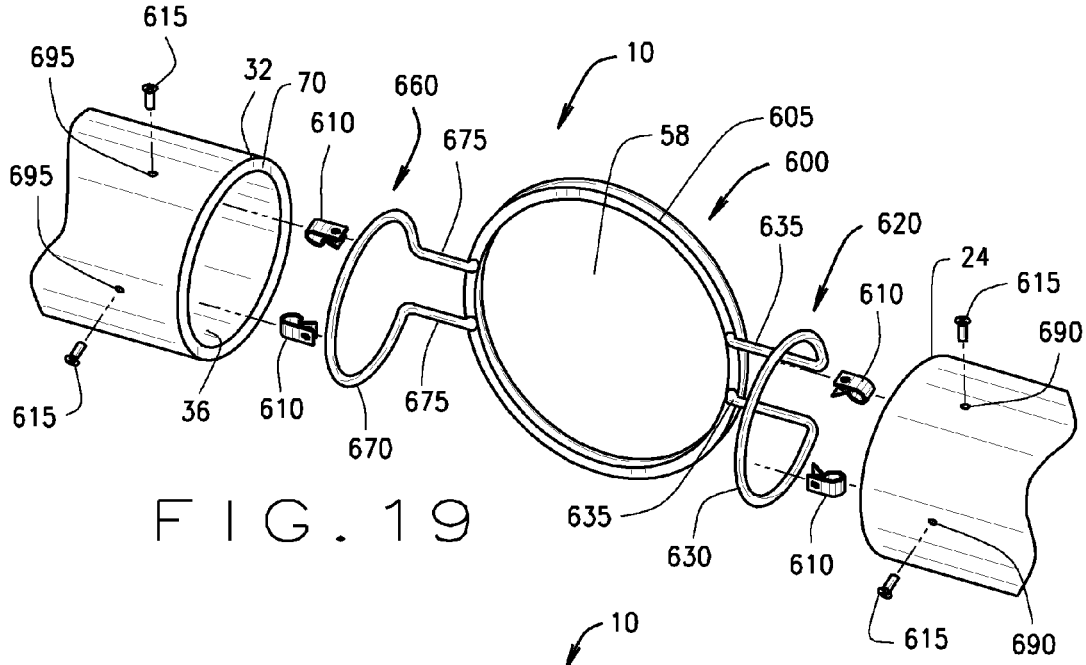
FIG. 19 is an exploded view of the sixth embodiment of the bunt training aid.
Figure 20:
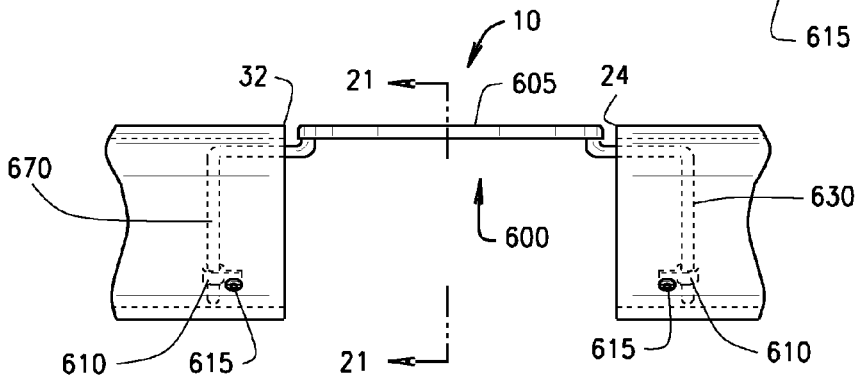
FIG. 20 is a top view of the receiving member of the sixth embodiment of the bunt training aid.
Figure 21:
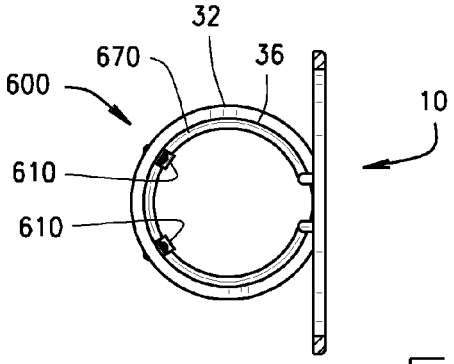
FIG. 21 is a cross-sectional view of the sixth embodiment of the bunt training aid.

With continued reference to FIGS. 19-21, the loops 630 and 670 form partial, circular structures that extend into the inside 28 of the handle portion 20 and into the inside 38 of the barrel portion 30. The loops 630 and 670 fit against the internal surface 26 of the handle portion 20 and against the internal surface 36 of the barrel portion 30. The loops 630 and 670 are connected or joined to the internal surfaces 26 and 36 via clips 610. Rivets 615 or other fasteners pass through the walls 60 and 70 via openings 690 and 695 to hold the clips 610 to the internal surfaces 26 and 36. The clips 610 tighten about the loops 630 and 670. The rivets 615 hold the loops 630 and 670 in place in the interior of the handle portion 20 and the barrel portion 30. The clips 610 and rivets 615 are generally placed opposite of the ball contacting surfaces 25 and 35, such that balls are not generally striking the rivets 615.

The bunt training aid 10 may be provided in both baseball and softball models that generally replicate the length and weight of a baseball or softball bat. For example, a softball version of the bunt training aid 10 may have a length of approximately 25 inches to approximately 34 inches. The softball version of the bunt training aid 10 may have a weight of approximately 15 ounces to approximately 25 ounces. For example, a baseball version of the bunt training aid 10 may have a length of approximately 25 inches to approximately 34 inches. The baseball version of the bunt training aid 10 may have a weight of approximately 13 ounces to approximately 31 ounces.

The openings 50, 51, 52, 53, 54, 58 of the receiving members 100, 200, 300, 400, 500, 600 may be provided to the player or incorporated into the bunt training aid 10 in different sizes depending upon the size of the ball used with the bunt training aid 10, as well as the desired training level needed and the skill of the player utilizing the bunt bat.

For example, a softball may range in size of approximately 3 and ¼ inches in diameter for beginning players, such as those at the age level of kindergarten to second grade. A softball may have a diameter of approximately 3 and ½ inches for a moderate level, such as those in third grade to fifth grade. Finally, a standard softball is approximately 3 and ⅘ inches in diameter for high school, collegiate and most adult recreational leagues. Baseballs generally have a diameter of approximately 2⅞ inches to 3 inches. The diameter of the openings 50, 51, 52, 53, 54, 58 may be adjusted to accommodate these different sizes of balls. The bunt training aid 10 may also be provided with different sized openings 50, 51, 52, 53, 54, 58. In the alternative, the bunt training aid 10 with the receiving member 500 may be adjusted by the player to their skill level and training preference by using different receiving members 500. The openings 50, 51, 52, 53, 54, 58 of the receiving members 100, 200, 300, 400, 500, 600 may also be provided to the player in different sizes depending upon the skill and expertise of the player.

When the openings 50, 51, 52, 53, 54, 58 are larger in diameter, it should be easier for the player to catch the ball in the receiving members 100, 200, 300, 400, 500, 600. However, the player will generally have the optimal bunting results and the optimal control of the bunted ball when the ball most squarely strikes the sweet spot of the bat. As such, the size of the openings 50, 51, 52, 53, 54, 58 are generally smaller for more skilled ball players, since the skilled ball players will be striving to strike the ball squarely on the sweet spot in order to obtain optimal control of the bunted ball.

Skilled softball players may want to use the opening 50, 51, 52, 53, 54, 58 that has an internal diameter that is approximately 1 inch larger in diameter than the diameter of the softball. Moderate softball players may want to use the opening 50, 51, 52, 53, 54, 58 that has an internal diameter that is approximately 1 and ½ inches larger in diameter than the diameter of the softball. Beginning softball players may want to use the opening 50, 51, 52, 53, 54, 58 that has an internal diameter that is approximately 1 and ⅞ inches larger in diameter than the diameter of the softball. As such, the internal diameter of the opening 50, 51, 52, 53, 54, 58 may range from approximately 4 and inches to approximately 6 inches for softball versions of the bunt training aid 10, although the internal diameter may be varied depending upon the player's skill level and training goals.

Skilled baseball players may want to use the opening 50, 51, 52, 53, 54, 58 that has an internal diameter that is approximately ⅜ inch larger in diameter than the diameter of the baseball. Moderate baseball players may want to use the opening 50, 51, 52, 53, 54, 58 that has an internal diameter that is approximately ½ inch larger in diameter than the diameter of the baseball. Beginning baseball softball players may want to use the opening 50, 51, 52, 53, 54, 58 that has an internal diameter that is approximately 1 inch to approximately 1 and ½ inches larger in diameter than the diameter of the baseball. As such, the internal diameter of the opening 50, 51, 52, 53, 54, 58 may range from approximately 3 and ¼ inches to approximately 5 inches for baseball versions of the bunt training aid, although the internal diameter may be varied depending upon the player's skill level and training goals.

The net 55 generally encircles the opening 50, 51, 52, 53, 54, 58 in order to catch the ball passing through the opening 50, 51, 52, 53, 54, 58. The net 55 may be made from a variety of suitable materials, such as nylon, poly, cotton, cotton-blends, or other synthetic blends. A depth of the net 55 may vary depending upon whether the net 55 is used with a softball or baseball version of the bunt training aid 10. A softball version of the bunt training aid 10 may have a depth of approximately 3 inches to approximately 6 inches, while a baseball version of the bunt training aid 10 may have a depth of approximately 3 inches to approximately 5 inches. Preferably, the net 55 has a closed end 57 opposite of the opening 50, 51, 52, 53, 54, 58 in order to catch and hold the ball in the net 55.

It should be understood from the foregoing that, while particular embodiments of the invention have been illustrated and described, various modifications can be made thereto without departing from the spirit and scope of the present invention. Therefore, it is not intended that the invention be limited by the specification; instead, the scope of the present invention is intended to be limited only by the appended claims.

What is claimed is:

1. A bunt training aid, comprising:

a handle portion, a barrel portion, a receiving member, the receiving member defining an opening sized to permit a ball to pass through the opening;

the receiving member comprising a first attachment member to attach the receiving member to the handle portion;

the receiving member comprising a second attachment member to attach the receiving member to the barrel portion;

the first attachment member extends into an inside of the handle portion, the first attachment member conforms to an internal surface of the handle portion, and the second attachment member extends into an inside of the barrel portion, the second attachment member conforms to an internal surface of the barrel portion, and the receiving member positioned between the handle portion and the barrel portion.

2. The bunt training aid according to claim 1, wherein the receiving member is attached to the handle portion and to the barrel portion via an attachment selected from the group consisting of welding, adhesives, epoxy, and rivets.

3. The bunt training aid according to claim 1, wherein the barrel portion and the handle portion generally deflect a ball away from the bunt training aid that strikes either the barrel portion or the handle portion.

4. The bunt training aid according to claim 1, wherein the opening of the receiving member is dimensioned to permit a softball, baseball, or other ball to pass through the opening, and wherein the opening of the receiving member is generally circular.

5. The bunt training aid according to claim 1, wherein the receiving member is a ring, wherein the ring has a generally round cross-section or a hemispherical cross-section.

6. The bunt training aid according to claim 1, wherein the receiving member comprises a closed net to catch the ball, wherein the closed net is removably attachable to the receiving member via net engaging members of the receiving member.

7. The bunt training aid according to claim 1, wherein the inside of the handle portion and the inside of the barrel portion are generally hollow.

8. The bunt training aid according to claim 1, wherein the handle portion comprises a first end and a second end, wherein the first end of the handle portion forms a handle for the bunt training aid, wherein the second end of the handle portion defines the internal surface, wherein the first attachment member is attached to the internal surface of the second end of the handle portion.

9. The bunt training aid according to claim 1, wherein the barrel portion comprises a first end and a second end, wherein the first end of the barrel portion defines the internal surface, wherein the second attachment member is attached to the internal surface of the first end of the barrel portion.

10. The bunt training aid according to claim 1, wherein the receiving member comprises a ring, and the first attachment and second attachment members extend from the ring.

11. A bunt training aid, comprising:

a handle portion, a barrel portion, a receiving member, the receiving member defining an opening sized to permit a ball to pass through the opening;

the receiving member comprising a first attachment member to attach the receiving member to the handle portion;

the receiving member comprising a second attachment member to attach the receiving member to the barrel portion;

the receiving member positioned between the handle portion and the barrel portion; wherein the receiving member comprises a ring, and the first attachment and second attachment members extend from the ring, and the first and second attachment members bend generally perpendicularly to the ring, the first attachment member forms a first loop, and the second attachment member forms a second loop.

12. A bunt training aid, comprising:

a handle portion, a barrel portion, a receiving member, the receiving member defining an opening sized to permit a ball to pass through the opening;

the receiving member comprising a first attachment member to attach the receiving member to the handle portion;

the receiving member comprising a second attachment member to attach the receiving member to the barrel portion;

the receiving member positioned between the handle portion and the barrel portion; and, wherein the first attachment member, the second attachment member, or both the first and second attachment members form a loop that contacts essentially an entire internal diameter of the handle portion, the barrel portion, or both the handle portion and the barrel portion.

13. The bunt training aid according to claim 1, wherein the first attachment member, the second attachment member, or both the first attachment member and the second attachment member comprises a flange, the flange comprising a curved attachment surface that corresponds to the internal surface of the barrel portion or to the internal surface of the handle portion.

14. The bunt training aid according to claim 13, wherein the curved attachment surface extends into the barrel portion or into the handle portion, wherein the curved attachment surface conforms to the internal surface of the handle portion or the barrel portion.

15. The bunt training aid according to claim 1, wherein the receiving member is removably positioned between the handle portion and the barrel portion, wherein the receiving member removably connects to the second end of the handle portion and to the first end of the barrel portion.

16. The bunt training aid according to claim 1, wherein the receiving member is removable positioned between the second end of the handle portion and the first end of the barrel portion via expandable engagement members positioned in the second end of the handle portion and in the first end of the barrel portion.

17. The bunt training aid according to claim 1, wherein the receiving member is attached to the handle portion via an attachment selected from the group consisting of adhesives, epoxy, rivets, and metal fasteners between the first attachment member and the handle portion, wherein the receiving member is further attached to the barrel portion via an attachment selected from the group consisting of welding, adhesives, epoxy, rivets, or metal fasteners between the second attachment member and the barrel portion.

18. The bunt training aid according to claim 1, wherein the receiving member is made from a material selected from the group consisting of steel, iron, metal, and metal alloys, and wherein the barrel portion and the handle portion are made from aluminum or aluminum alloy.

19. The bunt training aid according to claim 1, wherein the receiving member is positioned at approximately a sweet spot of the bunt training aid.

20. The bunt training aid according to claim 19, wherein the sweet spot is centered at approximately 4 inches to approximately 8 inches from the second end of the barrel portion.

21. The bunt training aid according to claim 1, wherein the barrel portion and the handle portion have generally round outer diameters that form ball contacting surfaces, and an outer ball contacting surface of the receiving member is positioned adjacent to the generally round outer diameters of the barrel portion and the handle portion such that the ball contacting surface of the receiving member is generally flush with the generally round outer diameters of the barrel portion and the handle portion.

22. The bunt training aid according to claim 1, wherein the bunt aid defines a longitudinal axis, and a plane of the opening of the receiving member is generally parallel to the longitudinal axis, wherein the barrel portion and the handle portion have circular cross-sections, and a plane of the opening of the receiving member is generally perpendicular to the circular cross-sections.

23. The bunt training aid according to claim 1, wherein the handle portion, the barrel portion, and the receiving member are separate components assembled into the bunt training aid.

24. A bunt training aid, comprising:

a handle for a user to grip;

a barrel to deflect balls directed toward the bunt training aid;

a ring with an opening configured to allow a ball to pass through the opening when the ball is directed toward the bunt training aid;

the ring fastened to the handle and to the barrel, the ring connecting the handle and the barrel;

the ring comprising a first attachment member that forms an expanding engagement member that expands to conform to an internal surface of the barrel;

the ring comprising a second attachment member that forms an expanding engagement member that expands to conform to an internal surface of the handle.

25. A bunt training aid, comprising:

a handle portion of an aluminum or aluminum alloy, wherein the first end of the handle portion forms a handle for the bunt training aid, wherein the second end of the handle portion is hollow and defines an internal surface;

a barrel portion of an aluminum or aluminum alloy, wherein the barrel portion comprises a first end and a second end, wherein the first end of the barrel portion is hollow and defines an internal surface;

a receiving member comprising a metallic ring, the receiving member defining a circular opening sized to permit a ball to pass through the opening;

the receiving member comprising a first attachment member to attach the receiving member to the handle portion, wherein the second end of the handle portion receives the first attachment member, and the first attachment member conforms to an internal surface of the second end of the handle portion;

the receiving member comprising a second attachment member to attach the receiving member to the barrel portion, wherein the first end of the barrel portion receives the second attachment member, and the second attachment member conforms to the internal surface of the first end of the barrel portion; and the receiving member is positioned between the handle portion and the barrel portion.

26. A bunt training aid, comprising:

a handle portion, a barrel portion, a receiving member, the receiving member defining an opening sized to permit a ball to pass through the opening;

the receiving member comprising a first attachment member to attach the receiving member to the handle portion;

the receiving member comprising a second attachment member to attach the receiving member to the barrel portion;

the first attachment member extends into an inside of the handle portion, the first attachment member fastens against an internal surface of the handle portion, and the second attachment member extends into an inside of the barrel portion, the second attachment member fastens against an internal surface of the barrel portion, and the receiving member positioned between the handle portion and the barrel portion;

wherein the first attachment member, the second attachment member, or both the first and the second attachment members form a structure selected from the group consisting of a loop structure, a circular structure, and a cylinder structure.

* * * * *